US005858941A

United States Patent [19]

Oakes et al.

[11] Patent Number: 5,858,941

[45] Date of Patent: Jan. 12, 1999

[54] COMPOSITIONS AND METHOD FOR REMOVAL OF OILS AND FATS FROM FOOD PREPARATION SURFACES

[75] Inventors: Thomas R. Oakes, Marine; Timothy A. Gutzmann, Eagan; Cynthia Lee Ross, Roseville; Bruce E. Schmidt, St. Paul, all of Minn.

[73] Assignee: Ecolab Inc., St. Paul, Minn.

[21] Appl. No.: 854,405

[22] Filed: May 12, 1997

[51] Int. Cl.[6] ..... C11D 1/62; C11D 7/06

[52] U.S. Cl. ..... 510/179; 134/40; 510/234; 510/272; 510/433; 510/438; 516/DIG. 7

[58] Field of Search ..... 252/357; 510/197, 510/234, 433, 438, 272; 134/40

[56] References Cited

U.S. PATENT DOCUMENTS

| | | | |
|---|---|---|---|
| 3,644,210 | 2/1972 | Crotty et al. | 510/197 |
| 3,694,365 | 9/1972 | Castner | 510/234 X |
| 3,705,856 | 12/1972 | Sedliar et al. | 510/234 |
| 3,865,939 | 2/1975 | Jandacek . | |
| 3,881,948 | 5/1975 | Schoenholz et al. | 134/2 |
| 4,005,195 | 1/1977 | Jandacek . | |
| 4,005,196 | 1/1977 | Jandacek et al. . | |
| 4,158,644 | 6/1979 | Hammerel | 510/365 |
| 4,174,304 | 11/1979 | Flanagan | 134/40 X |
| 4,176,080 | 11/1979 | Wise et al. | 134/40 X |
| 4,241,054 | 12/1980 | Volpenhein et al. . | |
| 4,264,479 | 4/1981 | Flanagan | 252/357 X |
| 4,264,583 | 4/1981 | Jandacek . | |
| 4,797,300 | 1/1989 | Jandacek et al. . | |
| 4,948,811 | 8/1990 | Spinner et al. | 426/601 X |
| 5,017,398 | 5/1991 | Jandacek et al. | 426/601 X |
| 5,230,823 | 7/1993 | Wise et al. | 510/433 X |
| 5,342,450 | 8/1994 | Cockrell, Jr. et al. | 134/3 |
| 5,380,468 | 1/1995 | Gober et al. | 510/433 X |
| 5,441,541 | 8/1995 | Mehreteab et al. | 8/137 |
| 5,523,013 | 6/1996 | Durbut et al. | 510/235 |
| 5,571,446 | 11/1996 | Rouillard | 510/234 |
| 5,663,132 | 9/1997 | Talley | 510/197 X |

FOREIGN PATENT DOCUMENTS

| | | |
|---|---|---|
| 0 121 949 | 10/1984 | European Pat. Off. . |
| 2 306 501 | 5/1997 | United Kingdom . |
| WO 91/09930 | 7/1991 | WIPO . |
| WO 95/14757 | 6/1995 | WIPO . |
| WO 95/35359 | 12/1995 | WIPO . |

*Primary Examiner*—Richard D. Lovering
*Attorney, Agent, or Firm*—Merchant, Gould, Smith, Edell, Welter & Schmidt, P.A.

[57] ABSTRACT

The invention is a method of removing soils containing oils and fats from food processing surfaces. The method includes the steps of formulating a wash composition from a two-part concentrate. The concentrate first part includes a source of alkalinity and water. The concentrate second part includes a quaternary ammonium compound. After formulation, the wash composition has a major portion of water, from about 100 ppm to 20,000 ppm of quaternary ammonium compound, and an alkali source present in a concentration to provide a pH of from about 10 to 14. After formulation, the wash composition may be used by applying it to the food processing surface. Optionally, the wash composition may also include a chelating agent and a second nonionic or anionic detersive agent.

41 Claims, No Drawings

COMPOSITIONS AND METHOD FOR REMOVAL OF OILS AND FATS FROM FOOD PREPARATION SURFACES

FIELD OF THE INVENTION

The invention relates generally to compositions and methods for use in removing fatty and oily soils from industrial food processing surfaces. More specifically, the invention relates to compositions and methods for removing soils comprising fats and oils which contain sucrose polyesters or polymerized triglycerides.

BACKGROUND OF THE INVENTION

Ready-to-eat foods are often cooked by boiling or frying in the presence of fats and oils. These foods may be prepared in larger industrial cooking appliances which cannot be disassembled to clean. Removal of soils from surfaces of industrial cooking appliances can be difficult, especially if the soils originate from an animal or vegetable source, such as charred animal or vegetable fats, fatty derivatives and other organic deposits.

Cleaning these surfaces has been a vexing problem in industries such as the food preparation industry, where essentially complete cleaning of such surfaces is desirable. For example, in industrial production plants, stainless steel cooking surfaces may be found in food fryers which are heated to high temperatures for the cooking of large amounts of food.

Soiling matter deposited on these surfaces may consist of a complex mixture of natural fats, fatty derivatives and other organic deposits from the cooking of food. During heating at high temperatures subsequent to deposition, this soiling matter may be converted into a charred, polymeric mass which is difficult to remove and which can comprise complex hydrocarbon chains containing fatty ester groups and ether linkages.

Removal of these soils from food fryers has customarily been accomplished by a process known in the industry as a "boil-out," which typically involves adding aqueous solution of a cleaner to a fryer, bringing the fryer to an elevated temperature, such as the boiling point of the cleaner, and maintaining the elevated temperature for a given period of time.

In the past, traditional cleaning methods have used high concentrations of caustic soda or caustic pot ash to saponify normal fat-based oils such as triglycerides used in processes such as deep fat frying. These oils are typically cottonseed or soybean oils. The saponification process breaks the triglycerides into their more soluble component fatty acids and glycerin.

Conventional cleaning compositions known previously include Hammerel, U.S. Pat. No. 4,158,644 which discloses a composition of quaternary ammonium salt, betaine, and nonionic surfactant. Hammer et. al. discloses the use of an aqueous composition containing these three surfactants and cleaning various fats and greases such as crankcase oil from hard surfaces.

Wise et. al. U.S. Pat. No. 4,176,080 discloses a detergent composition for oily soil removal from laundered dry goods. The Wise et. al. composition contains a water insoluble solvent with a water and oil emulsifier and a discrete amount of solvent stripping agent.

Flanagan, U.S. Pat. No. 4,264,479 discloses a generic composition of nonionic, amine oxide, and quaternary ammonium compound which may be mixed with certain chelating agents and sodium hydroxide to degrease and clean wax, soap, and other soils from hard surfaces.

However, modern trends towards healthier foods and, in turn, reduced caloric content, have resulted in the use of materials which provide reduced caloric content while maintaining the organoleptic properties of the food but which also create additional problems in cleaning food preparation surfaces.

For example, sucrose polyesters such as those disclosed in Jandeseck et. al., U.S. Pat. No. 4,797,300, Jandeseck et. al., U.S. Pat. No. 5,017,398, Spinner et. al., U.S. Pat. No. 4,948,811, Jandeseck, U.S. Pat. No. 3,865,939, Jandeseck, U.S. Pat. No. 4,005,195, Jandeseck et. al., U.S. Pat. No. 4,005,196, Jandeseck U.S. Pat. No. 4,264,583, and Volpingheim et. al., U.S. Pat. No. 4,241,054, all of which are incorporated herein by reference, have added benefits in reducing the caloric content of food while maintaining certain organoleptic properties.

Generally, the sucrose polyester is a sucrose molecule reacted with a fatty acid ester comprising anywhere from 6 to 8 carbons. The resultant molecule is large and stearically hindered. The stearic hindrance greatly slows the saponification making the cleaning process less efficient when traditional methods and compositions are used.

With traditional fryer cleaning solutions, the sucrose polyester generally does not emulsify or suspend in the cleaning solution. Rather, the sucrose polyester has a tendency to form a hard waxy film on the surface which is treated. Further, the removal of triglyceride oils and fats which have been carbonized, gelled, crosslinked or otherwise congealed have also presented a continuing problem in the cleaning of food preparation surfaces.

As a result, there is a need for compositions and methods which clean oily soils comprising sucrose polyesters from food preparation surfaces.

SUMMARY OF THE INVENTION

In accordance with a first aspect of the invention, there is provided a method of removing soils comprising oils and fats from food processing surfaces. The method comprises the step of applying a cleaning composition to the food processing surface. The composition comprises a major portion of water, a quaternary ammonium compound to provide detersive activity to the composition, and a source of alkalinity present in an amount effective to provide a pH ranging from about 8 to 14.

In accordance with a second aspect of the invention, there is provided a method of removing soils comprising oils and fats from food processing surfaces. The method comprises the steps of formulating a wash composition from a two-part concentrate. The concentrate first part comprises a source of alkalinity and water. The concentrate second part comprises a quaternary ammonium compound. The wash composition comprises a major portion of water, from about 100 ppm to 20,000 ppm of the quaternary ammonium compound, and an alkali source present in a concentration to provide a pH of from about 10 to 14. After formulation, the composition may be used by applying it to the food processing surface.

In accordance with a further aspect of the invention, there is provided a wash composition for use in removing soils comprising sucrose polyester oils and fats from food processing surfaces. The composition comprises a major portion of water, from about 100 ppm to 20,000 ppm of quaternary ammonium compound to provide detersive activity to the composition, and a source of alkalinity present in an amount effective to provide a pH ranging from about 10 to 14.

We have found that the claimed invention suspends and emulsifies soils comprising fats and oils, especially those comprising triglyceride oils, polymerized oils, sucrose polyesters, and mixtures thereof. The combination of quaternary ammonium compound and alkalinity sources has been found to be especially effective in removing sucrose polyester oils. Also, the composition of the invention has been found to be effective in removing triglyceride oils which have been polymerized, carbonized, or hardened during the cooking process. We have also found that by varying the concentration of alkalinity source, the fatty and oily-based soils may either be emulsified or separated as a phase which is separate from the aqueous phase of the cleaning composition during the cleaning process. Higher alkalinity concentrations cause this phase separation of the oils and fats. Separation of the oils and fats may allow for reuse of elements of the cleaning system without the need for further filtering processes.

DETAILED DESCRIPTION OF THE INVENTION

The invention includes compositions and methods for removing soils comprising oils and fats from food preparation surfaces. The method comprises the step of applying a cleaning composition to food preparation surfaces. The composition comprises a major portion of water, quaternary ammonium compound, and a source of alkalinity present in an amount effective to provide a pH ranging from about 8 to 14. optionally, the composition of the invention may also comprise a chelating agent or a second detersive agent.

The Quaternary Ammonium Compound

Generally, the invention comprises a quaternary ammonium halide surfactant having the formula:

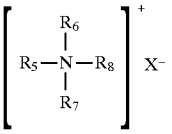

While not wishing to be bound to a theory, we believe that any quaternary ammonium compound may be used which heightens the efficacy of the caustic compound in reacting with, and decomposing, fats and oils. Especially with stearically hindered molecules such as sucrose polyesters, quaternary ammonium compounds which emulsify, suspend, or precipitate these molecules in solution are desirable.

Quaternary ammonium halide surfactants useful in the invention generally include compounds wherein $R_5$ and $R_6$ are lower (for example, $C_1$–$C_7$) alkyl, and preferably methyl groups; $R_7$ and $R_8$ are an alkyl group having about 1–18 carbon atoms substituted with a phenyl group, or an alkyl group having about 8–20, and preferably 8–18, carbon atoms; and X is a halogen, preferably chlorine.

Examples of suitable quaternary ammonium halide surfactants include dioctyl dimethyl ammonium chloride, octyl decyl dimethyl ammonium chloride, didecyl dimethyl ammonium chloride, ($C_{12-C18}$)n-alkyl dimethyl benzyl ammonium chloride, ($C_{12}$–$C_{14}$)n-alkyl dimethyl ethylbenzyl ammonium chloride, and dimethyl (difatty) ammonium chloride.

In one embodiment of the invention the quaternary ammonium halide surfactant used is a mixture of about (40% by weight $C_{12}$, 50% by weight $C_{14}$, and 10% by weight $C_{16}$)n-alkyl dimethyl benzyl ammonium chloride.

Also useful are quaternary ammonium compounds wherein $R_5$, $R_6$ and $R_7$ are lower (for example, $C_{1-C7}$) alkyl, and preferably methyl groups; $R_8$ is an alkyl or phenyl-substituted alkyl group having about 8–20, and preferably 8–18, carbon atoms; and X is an halogen, preferably chlorine.

The Source of Alkalinity

In order to provide an alkaline pH, the composition of the invention comprises an alkalinity source. Generally, the alkalinity sources raises the pH of the composition to at least about 8 in a 1 wt-% aqueous solution and generally to a range of from about 10 to 14, preferably from about 11 to 14, and most preferably from about 12 to 14.

This higher pH increases the efficacy of the soil removal and sediment breakdown when the composition is placed in use and further facilitates the rapid dispersion of oily soils. The general character of the alkalinity sources is limited only to those that do not contribute metal ions which promote the formation of precipitates or film salts. Exemplary alkalinity sources include hydroxides, silicates, and carbonates.

Alkali metal hydroxides have been found useful as an alkalinity source in the claimed invention. Alkali metal hydroxides are generally exemplified by species such as potassium hydroxide, sodium hydroxide, lithium hydroxide, and the like. Mixtures of these hydroxide species may also be used.

Silicates useful in accord with this invention include alkali metal ortho, meta-, di-, tri-, and tetrasilicates such as sodium orthosilicate, sodium sesquisilicate, sodium sesquisilicate pentahydrate, sodium metasilicate, sodium metasilicate pentahydrate, sodium metasilicate hexahydrate, sodium metasilicate octahydrate, sodium metasilicate nanohydrate, sodium disilicate, sodium trisilicate, sodium tetrasilicate, potassium metasilicate, potassium metasilicate hemihydrate, potassium silicate monohydrate, potassium disilicate, potassium disilicate monohydrate, potassium tetrasilicate, potassium tetrasilicate monohydrate, or mixtures thereof.

An additional source of alkalinity includes carbonates. Alkali metal carbonates which may be used in the invention include sodium carbonate, potassium carbonate, sodium or potassium bicarbonate or sesquicarbonate, among others. Preferred carbonates include sodium and potassium carbonates.

When the source of alkalinity is present in the composition at a concentration of at least about 1 wt.-%, the composition emulsifies fats and oils present on the surface of treatment. When the source of alkalinity is present in a concentration of about 3 wt-% or greater, the composition of the invention emulsifies, suspends, and separates the oils and fats after treatment.

The Chelating Agent

In order to prevent the formation of precipitates or other salts, the composition of the present invention generally comprises builders, chelating agents or sesquestrants. The chelating agent also functions to remove heat polymerized and carbonized fats and oils from the food preparation surface and suspend these products in the cleaning solution.

Generally, chelating agents such as sesquestrants are those molecules capable of coordinating the metal ions commonly found in service water and thereby preventing the metal ions from interfering with the functioning of detersive components within the composition. The number of covalent bonds capable of being formed by a sesquestrate upon a single hardness ion is reflected by labeling the sesquestrate as bidentate (2), tridentate (3), tetradendate (4), etc. Any number of sesquestrates may be used in accordance with the invention. Representative sesquestrates include salts of amino carboxylic acids, phosphonic acid salts, gluconates such as gluconic acid and gluconic acid salts, phosphates, and water soluble acrylic polymers, among others.

Suitable amino carboxylic acid chelating agents include N-hydroxyethyliminodiacetic acid, nitrolotriacetic acid (NTA), ethylenediaminetetraacetic acid (EDTA), N-hydroxyethyl-ethylenediaminetriacetic acid (HEDTA), and diethylenetriaminepentaacetic acid (DTPA).

Other suitable sesquestrates include water soluble acrylic polymers used to condition the wash solutions under end use conditions. Such polymers include polyacrylic acid, polymethacrylic acid, acrylic acid, acrylic acid-methacrylic acid copolymers, hydrolyzed polyacrylamide, hydrolyzed methacrylamide, hydrolyzed acrylamide-methacrylamide copolymers, hydrolyzed polyacrylonitrile, hydrolyzed polymethacrylonitrile, hydrolyzed acrylonitrile methacrylonitrile copolymers, or mixtures thereof. Water soluble salts or partial salts of these polymers such as their respective alkali metal (for example, sodium or potassium) or ammonium salts can also be used.

The weight average molecular weight of the polymers is from about 4000 to about 12,000. Preferred polymers include polyacrylic acid, the partial sodium salts of polyacrylic acid or sodium polyacrylate having an average molecular weight within the range of 4000 to 8000.

Also useful as sesquestrates are phosphonic acids and phosphonic acid salts. Such useful phosphonic acids include, mono, di, tri and tetra-phosphonic acids which can also contain groups capable of forming anions under alkaline conditions such as carboxy, hydroxy, thio and the like. Among these are phosphonic acids having the formula $R_1N[C_2PO_3H_2]_2$ or $R_2C(PO_3H_2)_2OH$, wherein $R_1$ may be—[(lower) alkylene]$N[CH_2PO_3H_2]_2$ or a third $(C_2PO_3H_2)$ moiety; and wherein $R_1$ is selected from the group consisting of $C_1$–$C_6$ alkyl.

The phosphonic acid may also comprise a low molecular weight phosphonopolycarboxylic acid such as one having about 2–4 carboxylic acid moieties and about 1–3 phosphonic acid groups. Such acids include 1-phosphono-1-methylsuccinic acid, phophonosuccinic acid and 2-phosphonobutane-1,2,4--tricarboxylic acid.

Phosphates which may be used as a chelating agent in accordance with the invention include cyclic phosphates such as sodium or potassium orthophosphate, alkaline condensed phosphates such as sodium or potassium pyrophosphate, sodium tripolyphosphate, sodium hexametaphosphate, tetrapotassium pyrophosphate, potassium polyphosphate, and the like.

The Second Detersive Agent

Optionally, the composition of the invention may comprise a second surfactant. Preferably, this second surfactant provides heightened detergency along with lower compositional surface tension as well as emulsification of oils and fats. Preferably, the second surfactant is a low-foaming surfactant such as a nonionic or anionic surfactant.

Nonionic surfactants which are useful in the invention include polyoxyalkylene nonionic detergents such as $C_{8-22}$ normal fatty alcohol-ethylene oxides or propylene oxide condensates, (that is the condensation products of one mole of fatty alcohol containing 8–22 carbon atoms with from 2 to 20 moles of ethylene oxide or propylene oxide); polyoxypropylene-polyoxyethylene condensates having the formula $HO(C_2H_4O)_x(C_3H_6O)_yH$ wherein $(C_2H_4O)_x$ equals at least 15% of the polymer and $(C_3H_6O)_y$ equals 20–90% of the total weight of the compound; alkylpolyoxypropylene-polyoxyethylene condensates having the formula $RO—(C_3H_6O)_x(C_2H_4O)_yH$ where R is a $C_{1-15}$ alkyl group and x and y each represent an integer of from 2 to 98; polyoxyalkylene glycols; butyleneoxide capped alcohol ethoxylate having the formula $R(OC_3H_4)_y(OC_4H_9)_xOH$ where R is a $C_{8-18}$ alkyl group and y is from about 3.5 to 10 and x is an integer from about 0.5 to 1.5; benzyl ethers of polyoxyethylene and condensates of alkyl phenols having the formula $R(C_6H_4)_x(OC_2H_4)_xOCH_2C_6H_5$ wherein R is a $C_{6-20}$ alkyl group and x is an integer of from 5 to 40; and alkyl phenoxy polyoxyethylene ethanols having the formula $R(C_6H_4)(OC_2H_4)_xOH$ wherein R is a $C_{8-20}$ alkyl group and x is an integer from 3 to 20.

Preferably, nonionics such as nonyl phenol ethoxylates, and linear alcohol ethoxylates may be used in the invention.

The second detersive agent may also comprise an anionic surfactant. We have found that certain anionic surfactants provide heightened emulsifying activity in the presence of a quaternary ammonium compound.

Anionic surfactants useful in the invention include sulfates, sulfonates, phosphate esters, carboxylates, and alkyloxylated carboxylates, among others. Sulfate and sulfonates include compounds such as linear alkyl $(C_{8-20})$ sulfates and sulfonates, alkali metal sulfates and sulfonates, alkali metal lauryl ether sulfates and sulfonates, olefinic sulfates and sulfonates, and mixtures thereof.

Carboxylate and ethoxylated carboxylates of the formula $R_{10}—O—(R_{11}R_{12}O—)_n$ H M are also useful in accordance with the invention as a second detersive agent wherein M is any water soluble cation, $R_{10}$ is a saturated or unsaturated $C_{8-C18}$ aliphatic, $R_{11}$ and $R_{12}$ are individually a $C_{1-4}$ alkylene, or succinic acid and N is a number from 1 to 25.

Preferably, the anionic surfactant comprises an oxalkylated linear alcohol carboxylic acid sodium salt such as Polytergent CS-1 from Olin Chemical Company.

Formulation and Use

The composition of the invention may be formulated for use from individual constituents or from a two-part concentrate. Generally, the two-part concentrate has a first part comprising a sequestrate, a quaternary ammonium compound and water. The second part of the two-part concentrate generally comprises a source of alkalinity, a sequestrate and a balance of water. Generally, the ratio of the first part of the concentrate to the second part of the concentrate is from about 1 to 10 to 10 to 1.

Provided in Table 1 are summary guidelines for constituent concentration in the use solution composition of the invention.

TABLE 1

(ppm)

| | Useful | Preferred | More Preferred |
|---|---|---|---|
| Quaternary Ammonium Compound | 10–10,000 | 100–5,000 | 500–2,500 |
| Alkalinity Source | 2,500–50,000 | 2,500–30,000 | 5,000–20,000 |

TABLE 1-continued

| | (ppm) | | |
|---|---|---|---|
| | Useful | Preferred | More Preferred |
| Chelating Agent | 10–10,000 | 100–5,000 | 100–1,000 |
| Second Surfactant | 10–20,000 | 100–5,000 | 250–2,500 |
| Water | Q.S. | Q.S. | Q.S. |
| pH | 8–14 | 10–14 | 12–14 |

Once formulated, the composition of the invention may be applied to food processing and preparation surfaces including utensils, appliances and cookware to remove both cold and hot oils and fats. Advantageously, the invention may be used to avoid surface prewashing and shorten the time of cleaning. Further, adjustment of the concentration of the alkalinity source allows emulsification as well as result, the invention makes possible the recycling of aqueous cleaner composition.

Generally, food preparation surfaces such as fryers may be cleaned by filling the fryer with the composition of the invention. The clean-in-place (CIP) system is generally filled to 0.5% to 5.0% with the composition of the invention, the remainder being wash water. The CIP system is then used to heat the cleaning composition to a temperature ranging from about 50° C. to 100° C. over a time period of about 5 minutes to 60 minutes. After this time, the cleaning composition is circulated in the CIP system for a time period ranging from about 5 minutes to 240 minutes or until a majority of the oils and fats are emulsified, suspended, and/or precipitated in the cleaning composition.

WORKING EXAMPLES

The following examples comprise a nonlimiting illustration of some of the properties and characteristics of the invention.

A series of Comparative and Working Examples were undertaken to determine the efficacy of the compositions and methods of the invention. After formulation, the composition of each Example was applied to a substrate having a soil comprising fats and oils. The results are reported with each of the Examples. Unless otherwise stated, all compositions prepared in the Working and Comparative Examples were aqueous having a balance of water.

Comparative Example 1

Aqueous alkaline solutions were prepared and applied to food preparation surfaces. An evaluation of concentration and type of alkalinity source was then made.

| Constituent | Example 1A | Example 1B | Example 1C | Example 1D |
|---|---|---|---|---|
| KOH, (45% w/w) | 5.56 | 11.1 | | |
| NaOH, (50% w/w) | | | 5 | 10 |

Application of the compositions illustrated that KOH (45% w/w) was more effective in removing oily soils than NaOH (50% w/w) when applied to food preparation surfaces.

Comparative Example 2

Aqueous compositions were then prepared using alternative alkalinity sources, (sodium hydroxide (NaOH), and potassium hydroxide (KOH)), mixed with potassium tripolyphosphate (KTPP).

| Constituent (wt-%) | Example 2A | Example 2B |
|---|---|---|
| KOH, (45% w/w) | 11.11 | 11.11 |
| KTPP, (60% w/w) | 8.35 | 16.70 |

When applied to hard surface areas, Comparative Example 2B comprising a higher relative concentration of potassium tripolyphosphate (60% w/w) was more effective in emulsifying oily soils.

Comparative Example 3

Example 3 was undertaken by first applying quaternary ammonium compound, ("QAC"), which was an alkyldimethyl benzylammonium halide (alkyl=40% $C_{12}$, 50% $C_{14}$, 10% $C_{16}$). After this pretreatment, a solution of potassium hydroxide (KOH) and tetrapotassium pyrophosphate (TKPP), was applied to this surface. The oily soils were mostly emulsified leaving a slight waxy ring after treatment.

| Constituent | Concentration (wt-%) |
|---|---|
| KOH, (45% w/w) | 5.56 |
| TKPP, (60% w/w) | 1.67 |
| QAC, (50% active) | 1.00 |

Comparative Example 4

In Comparative Example 4, an aqueous solution of nonylphenol ethoxylate having 9.5 moles of ethoxylation ("NPE 9.5") was added to a solution containing potassium hydroxide, (KOH), and tetrapotassium pyrophosphate (TKPP).

| Constituent | Concentration (wt-%) |
|---|---|
| KOH, (45% w/w) | 11.10 |
| TKPP (60% w/w) | 1.67 |
| NPE 9.5 | 0.50 |

When added, the presence of a nonylphenol ethoxylate (9.5 moles EO) did not increase the efficacy of soil removal. The composition of this Comparative Example was ineffective in emulsifying the soil and left a waxy film on the hard surface.

Comparative Example 5

Comparative Example 5 was formulated to contain water, potassium hydroxide, (KOH), and potassium polyphosphate, (KPP), and then applied to the surface containing the oily soil.

| Constituent | Concentration (wt-%) |
|---|---|
| KOH, (45% w/w) | 11.10 |
| KPP, (39% w/w) | 2.56 |

Application of the composition of this Comparative Example emulsified a portion of the soil but also left a slight waxy film on hard surface.

WORKING EXAMPLES

Working Example 1

According to the invention, water, potassium hydroxide (KOH), potassium polyphosphate (KPP), and a quaternary ammonium compound, (QAC), of alkyldimethyl benzyl ammonium chloride (alkyl equaling 40% $C_{12}$, 50%, 10% $C_{16}$) were mixed in an aqueous solution and applied to an oily soil containing surface.

| Constituent | Concentration (wt-%) |
|---|---|
| KOH, (45% w/w) | 11.10 |
| KPP, (39% w/w) | 2.56 |
| QAC, (50% active) | 1.00 |

Application of the composition of this working example emulsified all of the soil and left no waxy film.

Working Example 2

According to the invention, Working Examples 2A and 2B were formulated containing a quaternary ammonium compound, ("QAC"), and alkyl dimethyl benzyl ammonium chloride (alkyl equaling 40% $C_{12}$, 50% $C_{14}$, 10% $C_{16}$), potassium hydroxide (KOH), and tetrapotassium pyrphosphate (TKPP) and potassium polyphosphate (KPP).

| Constituent (wt-%) | Example 2A | Example 2B |
|---|---|---|
| KOH, (45% w/w) | 11.11 | 11.11 |
| TKPP, 60% w/w) | 1.67 | — |
| QAC, (50% active) | 0.50 | 0.50 |
| KPP, (39% w/w) | — | 2.56 |

Both compositions emulsified the soils. Example 2B seemed to work more effectively in fully emulsifying the soils.

Working Example 3

Working Example 3 was formulated as an aqueous solution containing quaternary ammonium compound (QAC), of alkyl dimethyl benzyl ammonium chloride (alkyl equaling 40% $C_{12}$, 50% $C_{14,\ 10}$% $C_{16}$), potassium hydroxide (KOH), and potassium polyphosphate (KPP).

| Constituent | Concentration (wt-%) |
|---|---|
| KOH, (45% w/w) | 11.10 |
| KPP, (39% w/w) | 0.84 |
| QAC, (50% active) | 0.10 |

This Working Example used a lower concentration of quaternary ammonium compound. However, when applied this composition was the first to emulsify both hot and cold soils.

Working Example 4

Working Example 4 was prepared as an aqueous solution of a quaternary ammonium compound (QAC) of an alkyl dimethyl benzyl ammonium chloride (alkyl equaling 40% $C_{12}$, 50% $C_{14}$, 10% $C_{16}$), potassium hydroxide (KOH), and potassium polyphosphate (KPP).

| Constituent | Concentration (wt-%) |
|---|---|
| KOH, (45% w/w) | 11.10 |
| KPP (39% w/w) | 0.84 |
| QAC (50% active) | 2.00 |

With this Working Example, soils were emulsified in the solution and separated upon cooling. There was no waxy build up left upon the hard surface after cleaning.

Working Example 5

In Working Example 5, two aqueous compositions were formulated to evaluate the effect of having potassium polyphosphate, (KPP), in the composition. The quaternary ammonium compound was the same as that used in Working Example 4.

| Constituent (wt-%) | Example 5A | Example 5B |
|---|---|---|
| KOH (45% w/w) | 0.16 | 0.16 |
| NaOH (50% w/w) | 5.98 | 5.98 |
| KPP (39% w/w) | | 0.84 |
| QAC (50% Active) | 0.10 | 0.10 |
| Sodium Gluconate (40% w/w) | 0.26 | 0.26 |
| Gluconic Acid (50% w/w) | 0.50 | 0.50 |
| Nonionic Surfactant[1] | 0.03 | 0.03 |
| Nonionic Surfactant[2] | 0.03 | 0.03 |

[1]EP/PO block nonionic surfactant, Avg. 19 moles EO and Avg. 28 moles PO.
[2]EP/PO block nonionic surfactant, Avg. 13 moles EO and Avg. 24 moles PO.

Upon application, the potassium polyphosphate, KPP, helps keep soil emulsified, slows down separation.

Working Example 6

In Working Example 6 various aqueous formulations were prepared to determine the effect of various levels of quaternary ammonium compound (QAC) relative to caustic. The QAC was the same as used in Working Example 5.

| Constituent (wt-%) | Example 6A | Example 6B | Example 6C | Example 6D |
|---|---|---|---|---|
| KOH (45% w/w) | 0.16 | 0.16 | 0.47 | 0.16 |
| NaOH (50% w/w) | 3.68 | 2.30 | 5.98 | 7.36 |
| KPP (39% w/w) | 0.40 | 0.40 | 0.40 | 0.40 |
| QAC (50% active) | 0.10 | 0.10 | 0.30 | 0.10 |
| Sodium Gluconate, 40% | 0.16 | 0.10 | 0.26 | 0.32 |
| Gluconic Acid, 50% | 0.50 | 0.50 | 1.50 | 0.50 |
| Nonionic Surfactant[1] | 0.02 | 0.01 | 0.03 | 0.03 |
| Nonionic Surfactant[2] | 0.02 | 0.01 | 0.03 | 0.03 |

[1]EP/PO block nonionic surfactant, Avg. 19 moles EO and Avg. 26 moles PO.
[2]EP/PO block nonionic surfactant, Avg. 13 moles EO and Avg. 24 moles PO.

These Examples showed that a higher concentration of caustic caused faster solution separation. Higher QAC concentration also generally caused faster solution separation. Caustic concentration seemed to have a greater effect on soil emulsification and separation than QAC concentration.

Working Example 7

A trial was undertaken using an aqueous solution of the composition shown below. The QAC was the same as used in Working Example 7.

| Constituent | Concentration (wt-%) |
|---|---|
| KOH (45% w/w) | 0.16 |
| NaOH (50% w/w) | 2.3 |
| KPP (39% w/w) | 0.4 |
| QAC (50% active) | 0.1 |
| Gluconic Acid, 50% | 0.5357 |
| Triton BG-10 | 0.001 |

A fryer was filled and charged 750–800 gallons of the composition shown above. The solution was allowed to heat to the normal 180° F. In addition, the de-oiler box was heated to about 200° F. before solution transfer during CIP.

After only 20 minutes into the CIP cycle, the solution foamed out of the fryer. After a total cycle time of 3 hours, CIP was shut down. Foam had continued to build in the fryer, coating even the top of the hood. The resulting overflow removed the carbonized soil off the fryer rails. The foam also pulled an unusually large quantity of fines out of the filters. The fryer looked very clean after only three hours.

Working Example 8

The following working solutions were formulated in accordance with the invention.

| | Example | | | | | |
|---|---|---|---|---|---|---|
| Component | 8A | 8B | 8C | 8D | 8E | 8F |
| Water | Q.S. | Q.S. | Q.S. | Q.S. | Q.S. | Q.S. |
| KOH 45% | 800 ppm | 800 ppm | 800 ppm | 800 ppm | 800 ppm | 800 ppm |
| NaOH 50% | 1.14% | 1.14% | 1.14% | 1.14% | 1.14% | 1.14% |
| Sodium Gluconate 40% | 200 ppm | 200 ppm | 200 ppm | 200 ppm | 200 ppm | 200 ppm |
| Gluconic Acid 50% | 2500 ppm | 2500 ppm | 2500 ppm | 2500 ppm | 2500 ppm | 2500 ppm |
| KPP | 400 ppm | 400 ppm | 400 ppm | 400 ppm | 400 ppm | 400 ppm |
| QAC | 500 ppm | 500 ppm | 500 ppm | 500 ppm | — | 500 ppm |
| LAS | — | 500 ppm | — | — | — | — |
| SLS | — | — | 500 ppm | — | — | |
| Polytergent CS-1 | — | — | — | 1000 ppm | 1000 | |

LAS = Linear alkylbenzene sulfonic acid
SLS = Sodium Lauryl Sulfate
KPP = Potassium polyphosphate
QAC = Alkyldimethylbenzyl ammonium chloride (R = 40% C12; 50% C14; 10% C16)
Polytergent CS-1 = polycarboxylated, linear alcohol alkoxylate To evaluate Examples 8A through 8E, a sample of 1.0+/±0.5 gram of heat-treated Sucrose Polyester (Olestra) was weighted into a 150 ml glass beaker. 100 ml of test solution was then poured into a test beaker and heated with stirring to 180° F. (for approximately 20 minutes). The system was held at 180° F. for 60 minutes, with continued agitation in the test beaker. After boilout, the test beaker was removed from the hot plate and allowed to cool.

| Example | Observations |
|---|---|
| 6A | Fully emulsified the sucrose polyester within 40 minutes |
| 8B | Same as standard |
| 8C | Same as standard |
| 8D | Fully emulsified the sucrose polyester within 20 minutes |
| 8E | Did not emulsify the sucrose polyester |

The results indicate that standard anionic surfactants added to the invention do not negatively or positively affect the emulsification of the sucrose polyester soil. But the polycarboylated, linear alcohol alkoxylate, sodium salt does improve the speed of the emulsification process.

The above specification, examples and data provide a complete description of the manufacture and use of the article of the invention. Since many embodiments of the invention can be made without departing from the spirit and scope of the invention, the invention resides in the claims hereinafter appended.

The claimed invention is:

1. A method of removing soils comprising sucrose polyester oils and fats from food processing surfaces, said method comprising the step of applying a cleaning composition to the food processing surface, said composition comprising a major portion of water and (a) an amount of quaternary ammonium compound effective to provide detersive activity to the composition; and (b) a source of alkalinity present in an amount effective to provide a pH ranging from about 8 to 14.

2. The method of claim 1, wherein the quaternary ammonium compound comprises alkyl dimethyl benzyl ammonium halide.

3. The method of claim 1, wherein the quaternary ammonium compound is selected from the group consisting of alkyl dimethyl benzyl ammonium halide, alkyl dimethyl ethyl benzyl ammonium halide and mixtures thereof.

4. The method of claim 1, wherein said source of alkalinity is present in an amount of at least about 2500 ppm and once applied to the food preparation surface said composition emulsifies said fats and oils.

5. The method of claim 1, wherein said oils and fats comprise one or more sucrose polyesters.

6. The method of claim 1, wherein said oils and fats comprise one or more triglycerides.

7. The method of claim 6, wherein said triglycerides are polymerized.

8. The method of claim 1, wherein said source of alkalinity is selected from the group consisting of potassium hydroxide, sodium hydroxide, and mixtures thereof and wherein said alkalinity source is present in said composition in a concentration which after application causes emulsification and phase separation of said oils and fats from said composition.

9. The method of claim 8, wherein said composition comprises at least about 2500 ppm sodium hydroxide.

10. The method of claim 1, wherein said composition comprises a chelating agent.

11. The method of claim 10, wherein said chelating agent is selected from the group consisting of an amino carboxylic acid, a gluconate, a phosphate, an acrylic polymer, and mixtures thereof.

12. The method of claim 10, wherein said chelating agent comprises gluconic acid.

13. The method of claim 10, wherein said chelating comprises an alkali or alkaline earth phosphate.

14. The method of claim 1, wherein said composition additionally comprises a second detersive agent.

15. The method of claim 14, wherein said second detersive agent comprises an anionic surfactant.

16. The method of claim 15, wherein said anionic surfactant comprises an oxyalkylated linear alcohol carboxylic acid sodium salt.

17. A method of removing soils comprising sucrose polyester oils and fats from food processing surfaces, said method comprising the steps of:

(a) formulating a wash composition from a two-part concentrate, said concentrate first part comprising a source of alkalinity and water, said concentrate second part comprising a quaternary ammonium compound, wherein after formulation said wash composition comprises a major portion of water, from about 100 ppm to 20,000 ppm of said quaternary ammonium compound, and an alkali source present in a concentration effective to provide a pH of from about 10 to 14; and (b) applying said wash composition to the food processing surface.

18. The method of claim 17, wherein the quaternary ammonium compound comprises alkyl dimethyl benzyl ammonium halide.

19. The method of claim 17, wherein the quaternary ammonium compound is selected from the group consisting of alkyl dimethyl benzyl ammonium halide, alkyl dimethyl ethyl benzyl ammonium halide and mixtures thereof.

20. The method of claim 17, wherein said source of alkalinity is present in an amount of at least about 2500 ppm and once applied to the food preparation surface said composition emulsifies said fats and oils.

21. The method of claim 17, wherein said source of alkalinity is selected from the group consisting of potassium hydroxide, sodium hydroxide, and mixtures thereof and wherein said alkalinity source is present in said composition in a concentration which after application causes emulsification and phase separation of said oils and fats from said composition.

22. The method of claim 21, wherein said composition comprises at least about 2500 ppm sodium hydroxide.

23. The method of claim 17, wherein said composition comprises a chelating agent.

24. The method of claim 23, wherein said chelating agent is selected from the group consisting of an amino carboxylic acid, a gluconate, a phosphate, an acrylic polymer, and mixtures thereof.

25. The method of claim 23, wherein said chelating agent comprises gluconic acid.

26. The method of claim 23, wherein said chelating agent comprises an alkali or alkaline earth phosphate.

27. The method of claim 17, wherein said composition additionally comprises a second detersive agent.

28. The method of claim 27, wherein said second detersive agent comprises an anionic surfactant.

29. The method of claim 28, wherein said anionic surfactant comprises an oxyalkylated linear alcohol carboxylic acid sodium salt.

30. A wash composition for use in removing soils comprising sucrose polyester oils and fats from food processing surfaces, said composition comprising a major portion of water and (a) from about 100 ppm to 20,000 ppm of quaternary ammonium compound effective to provide detersive activity to the composition;

(b) from about 10 to 10,000 ppm of a chelating agent, said chelating agent comprising gluconic acid or a salt thereof; and (c) a source of alkalinity present in an amount effective to provide a pH ranging from about 10 to 14.

31. The composition of claim 30, wherein the quaternary ammonium compound comprises alkyl dimethyl benzyl ammonium halide.

32. The composition of claim 30, wherein the quaternary ammonium compound is selected from the group consisting of alkyl dimethyl benzyl ammonium halide, alkyl dimethyl ethyl benzyl ammonium halide and mixtures thereof.

33. The composition of claim 30, wherein said source of alkalinity is present in an amount of at least about 2500 ppm and once applied to the food preparation surface said composition emulsifies said triglyceride fats and oils.

34. The composition of claim 30, wherein said source of alkalinity is selected from the group consisting of potassium hydroxide, sodium hydroxide, and mixtures thereof and wherein said alkalinity source is present in said composition in a concentration which after application causes emulsification and phase separation of said oils and fats from said composition.

35. The composition of claim 30, wherein said alkalinity source comprises at least about 2500 ppm sodium hydroxide.

36. The composition of claim 30, wherein said composition additionally comprises a second chelating agent, said second chelating agent is selected form the group consisting of an amino carboxylic acid, a phosphate, an acrylate polymer, and mixtures thereof.

37. The composition of claim 36, wherein said second chelating agent comprises an alkali or alkaline earth polyphosphate.

38. The composition of claim 30, wherein said chelating agent comprises gluconic acid.

39. The composition of claim 30, wherein said composition additionally comprises a second detersive agent.

40. The composition of claim 39 wherein said second detersive agent comprises an anionic surfactant.

41. The composition of claim 40 wherein said anionic surfactant comprises an oxyalkylated linear alcohol carboxylic acid sodium salt.

* * * * *